US006244597B1

(12) United States Patent
Matijek

(10) Patent No.: US 6,244,597 B1
(45) Date of Patent: Jun. 12, 2001

(54) LOGICAL BALL-SHAPED TOY WITH BROKEN SURFACE INCLUDING ROTATED AND PERMUTATED ELEMENTS

(75) Inventor: Josip Matijek, Sarajevo (BA)

(73) Assignees: Lanco, D.O.O., Sarajevo (BA); Teca, D.O.O. (SI)

( * ) Notice: Subject to any disclaimer, the term of this patent is extended or adjusted under 35 U.S.C. 154(b) by 0 days.

(21) Appl. No.: 09/101,947

(22) PCT Filed: Nov. 12, 1996

(86) PCT No.: PCT/SI96/00028

§ 371 Date: Jul. 15, 1998

§ 102(e) Date: Jul. 15, 1998

(87) PCT Pub. No.: WO97/26059

PCT Pub. Date: Jul. 24, 1997

(30) Foreign Application Priority Data

Jan. 17, 1996 (BA) ..... P960022A

(51) Int. Cl.[7] ..... A63F 9/08

(52) U.S. Cl. ..... 273/153 S

(58) Field of Search ..... 273/153 S

(56) References Cited

U.S. PATENT DOCUMENTS 4,441,715 * 4/1984 Titus ..... 273/153 S
4,865,323 * 9/1989 Heusinkveld ..... 273/153 S

FOREIGN PATENT DOCUMENTS

210182 * 2/1982 (DE) ..... 273/153 S
3127757 * 3/1983 (DE) ..... 273/153 S
2600903 * 1/1988 (FR) ..... 273/153 S

* cited by examiner

*Primary Examiner*—Steven Wong
(74) *Attorney, Agent, or Firm*—Abelman, Frayne & Schwab

(57) ABSTRACT

A logical ball-shaped toy comprises rotated elements with lateral projections shape-connected to permutated elements with grooves. A segment of the toy, which is rotatable by the application of manual force, comprises one rotated element and three permutated elements.

1 Claim, 11 Drawing Sheets

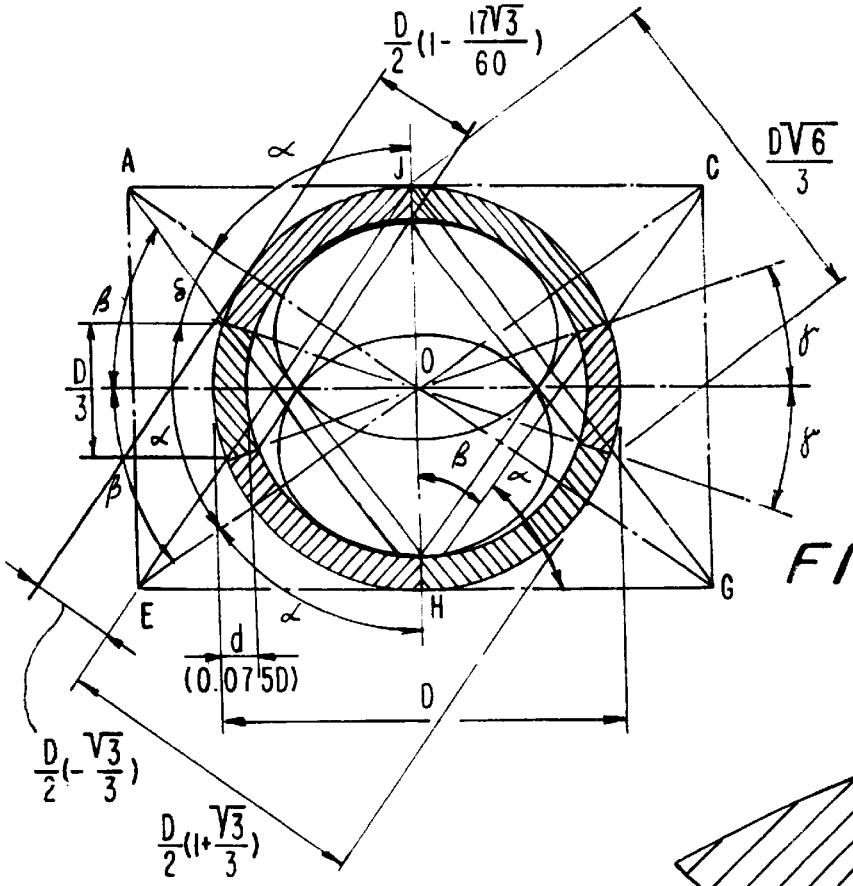

FIG. 1D

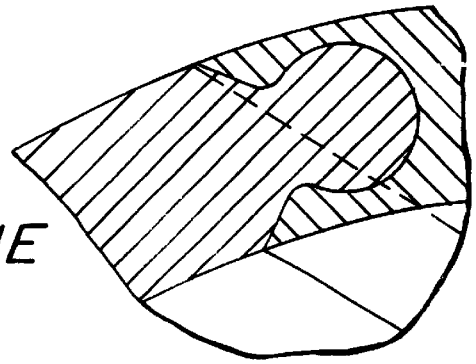

FIG. 1E

| |
|---|
| $\alpha = 54.73561032° = 54° 44' 8.2''$<br>$\sin\alpha = \frac{\sqrt{6}}{3}$; $\cos\alpha = \frac{\sqrt{3}}{3}$; $\lg\alpha = \sqrt{2}$; |
| $\beta = 35.26438968° = 35° 15' 51.8''$<br>$\sin\beta = \frac{\sqrt{3}}{3}$; $\cos\beta = \frac{\sqrt{6}}{3}$; $\lg\beta = \frac{\sqrt{2}}{2}$; |
| $\gamma = 19.47122065° = 19° 28' 16.4''$<br>$\sin\gamma = \frac{1}{3}$; $\cos\gamma = \frac{2\sqrt{2}}{3}$; $\lg\gamma = \frac{\sqrt{2}}{4}$; |
| $\delta = 15.79316905° = 15° 47' 35.4''$<br>$\sin\delta = \frac{\sqrt{6}}{9}$; $\cos\delta = \frac{5\sqrt{3}}{9}$; $\lg\delta = \frac{\sqrt{2}}{5}$; |

FIG. 1F

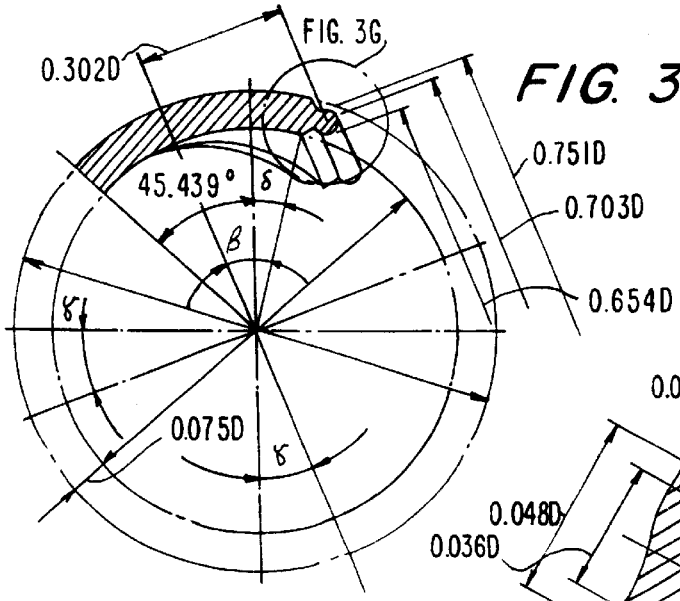
FIG. 3E
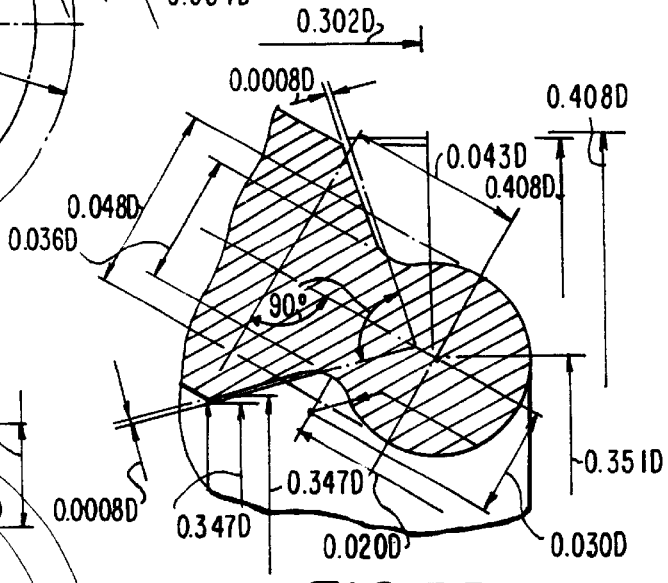
FIG. 3F
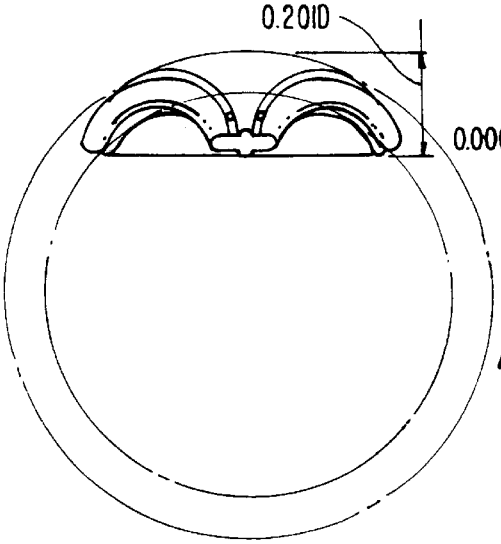
FIG. 3D
FIG. 3H
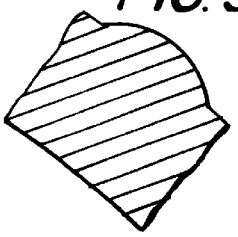
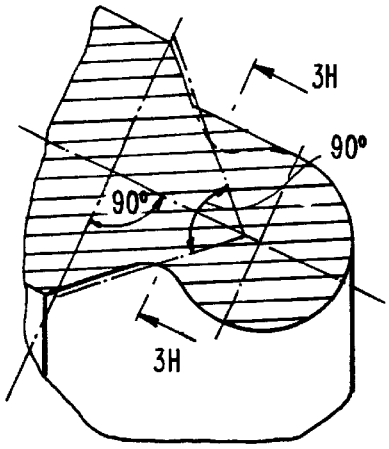
FIG. 3G

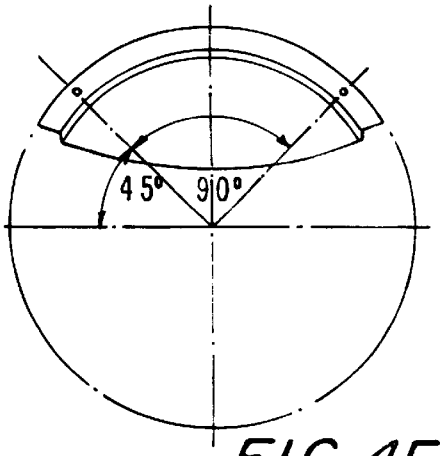
FIG. 4E
FIG. 4F
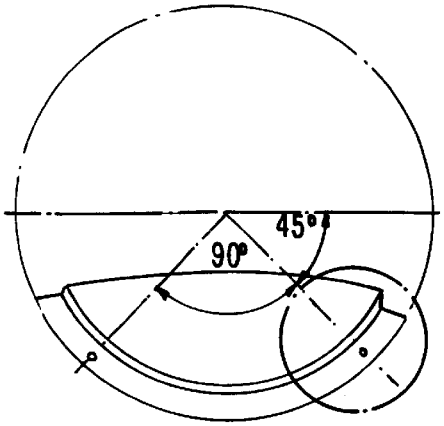
FIG. 4G
FIG. 4G
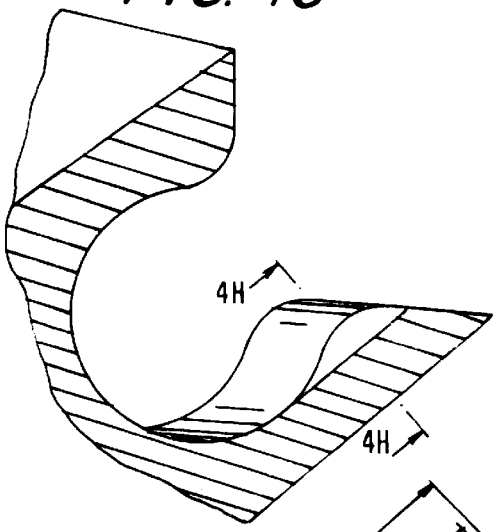
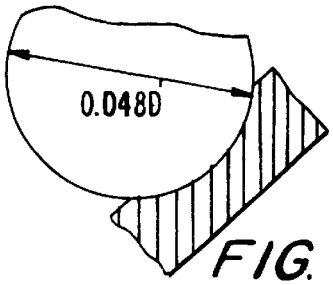
FIG. 4H
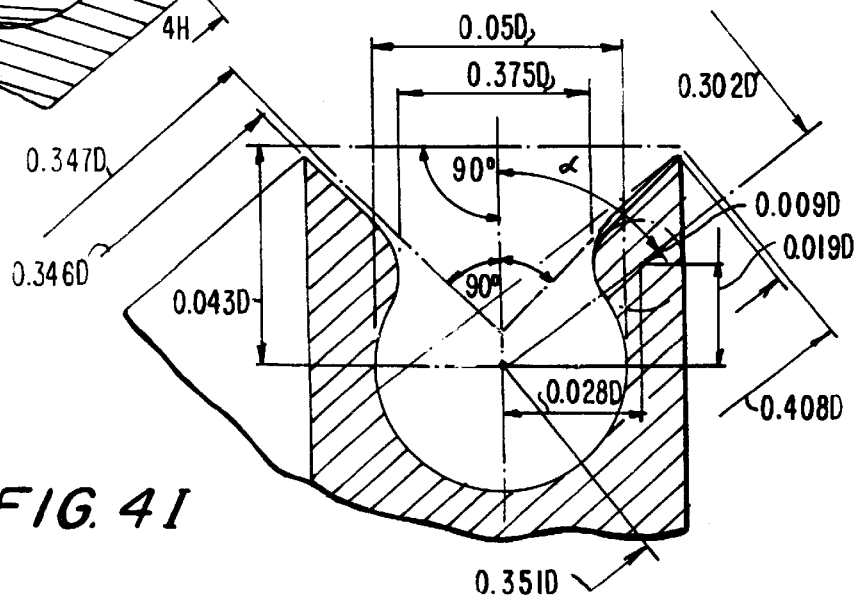
FIG. 4I

LOGICAL BALL-SHAPED TOY WITH BROKEN SURFACE INCLUDING ROTATED AND PERMUTATED ELEMENTS

FIELD OF THE INVENTION

According to the International Patent Classification this invention may be classified as follows: A 63 F 9/08—(combination toy, made up of reciprocally shiftable elements); A 63 H 33/04 (construction toys); A 63 H 33/06 ( . . . combined without application of additional parts).

BACKGROUND OF THE INVENTION

The technical problem to be solved by this invention involves the following:

a. breaking a ball with diameter "D" and wall thickness "d" into elements which, when mutually joined, will form a ball;

b. connecting the elements so as to allow for reciprocal interconnection as well as for rotation and permutation of the elements, aiming at the fact that through rotation of ball segments around the diagonal of a cube in which the ball can be inscribed the elements will be brought into a definite position; and c. positioning of individual ball segments (elements).

SUMMARY OF THE INVENTION

The logical ball-shaped toy with broken surface including rotated and permutated elements solves the problems of the construction of toy elements, and their interconnection, as well as the rotation and permutation of elements. Through rotation of ball segments (a segment comprises of four interconnected elements—three permutated and one rotated element) around the diagonal of to described cube the elements are brought into a definite position through audible and tactile effects, (FIG. 1).

The ball of diameter "D" and wall thickness "d" is penetrated by eight surface lines of "OM" length (the "OM" length equals D $\sqrt{3}/2$) which, rotating around the diagonals of a cube in which the ball can be inscribed, form eight conical surfaces with peaks in the centre of the ball. The rotation diameter of point "M" equals the length of a diagonal of a square face of the cube in which the ball can be inscribed (D $\sqrt{2}$). The penetration of the created conical surfaces (cones) through the ball (of diameter "D" and wall thickness "d") results in eight rotated elements 1 and twelve permutated elements 2.

The rotated element 1 forms the space between three reciprocally tangent ball segments and the permutated element 2 forms the space which equals the cross-section of the combination of two segments. The bisecting lines through the peaks of rotated elements reciprocally dose a 120° angle.

The created elements (eight rotated elements and twelve permutated elements) are interconnected by link joints which provide for simultaneous interconnection and mobility, enabling rotation of eight segments (a segment consists of one rotated and three permutated elements) around the diagonals of the cube in which the ball can be inscribed in shifts of 120°. By rotation of ball segments there may be created a maximum number, N, of different combinations where N is equal to $$3^8 \times 12! = 3{,}142{,}729{,}497{,}600$$

BRIEF DESCRIPTION OF THE DRAWINGS

The logical ball-shaped toy with broken surface including rotated and permutated elements is shown in the enclosed drawings, where

FIG. 1D is a cross-sectional view of the ball of FIG. 1C rotated 90° downwardly;

FIG. 1E is an enlarged segmented view of the circled section of FIG. 2D, partly in cross-section, illustrating two of the elements of the ball in mated relation;

FIG. 1F is a table of values of the angles shown in FIG. 1D;

FIG. 3D is a cross-sectional view of the rotated element shown in FIG. 3C along line 3D—3D;

FIG. 3E is an enlarged and detailed view of the circled cross-sectional segment shown in FIG. 3D;

FIG. 3F is a perspective view of the rotated element of FIG. 3D rotated 90° to the right;

FIG. 3G is an enlarged cross-sectional view of the portion of the element shown in FIG. 3B taken along section line 3G—3G;

FIG. 3H is a cross-sectional view of the portion of the rotated element shown in FIG. 3G taken along line 3H—3H;

FIG. 4E is a perspective view of the inside of the permutator of FIG. 4A taken from an angle B as shown in FIG. 4C;

FIG. 4F is a perspective view of the inside of the permutator element shown in FIG. 4E, rotated 90° downward;

FIG. 4G is an enlarged detail of the mating section of the permutator element shown partly in section;

FIG. 4H is a cross-sectional view of a portion of the element shown in FIG. 4G taken along section line 4H—4H;

FIG. 4I is an enlarged detail of the circled section of FIG. 4C taken along line 4I—4I;

DETAILED DESCRIPTION OF THE INVENTION

Figure 1A:
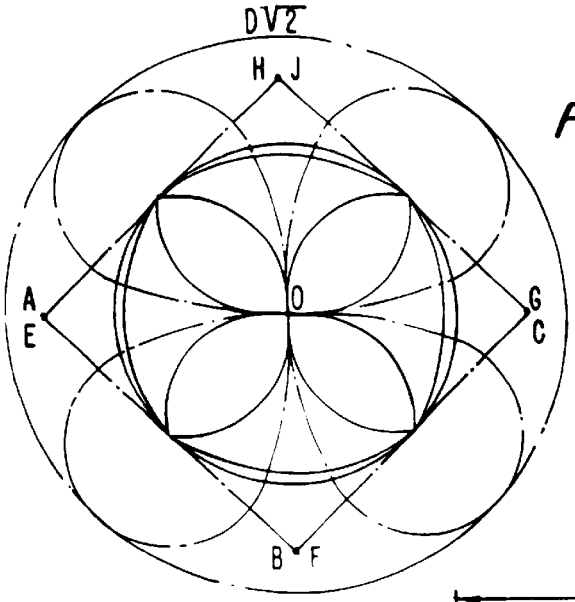
FIG. 1A is a top plan view of the ball of the invention inscribed in a cube having a side equal to the diameter of the ball.
Figure 1B:
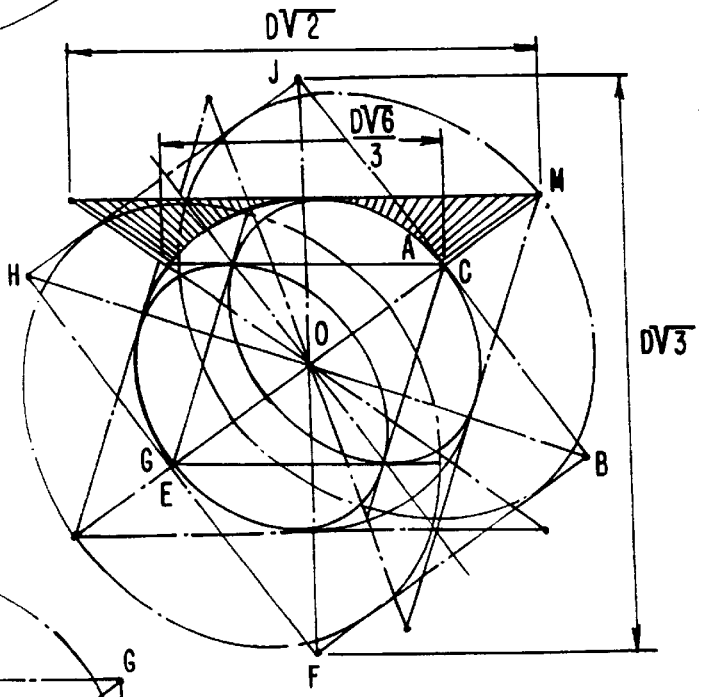
FIG. 1B is a left side view of the ball shown in FIG. 1A.
Figure 1C:
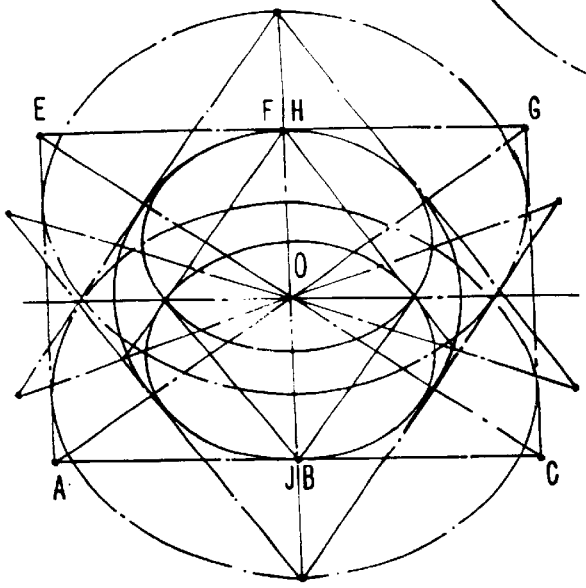
FIG. 1C is a view of the ball of FIG. 1A rotated 90° downwardly.
Figure 2A:
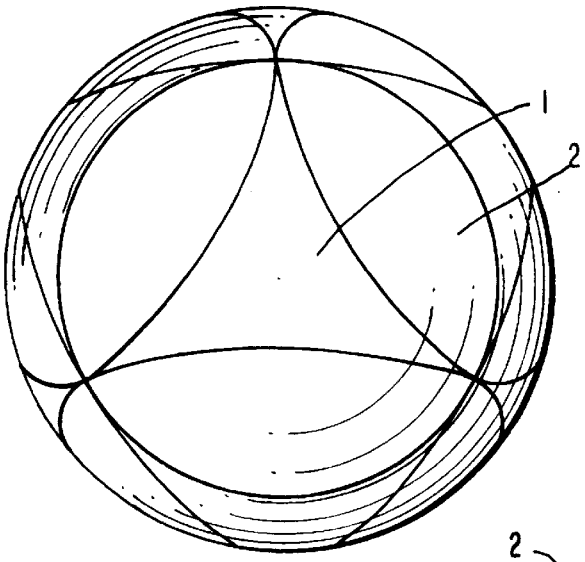
FIG. 2A is a top perspective view of the ball assembled from its component elements.
Figure 2B:
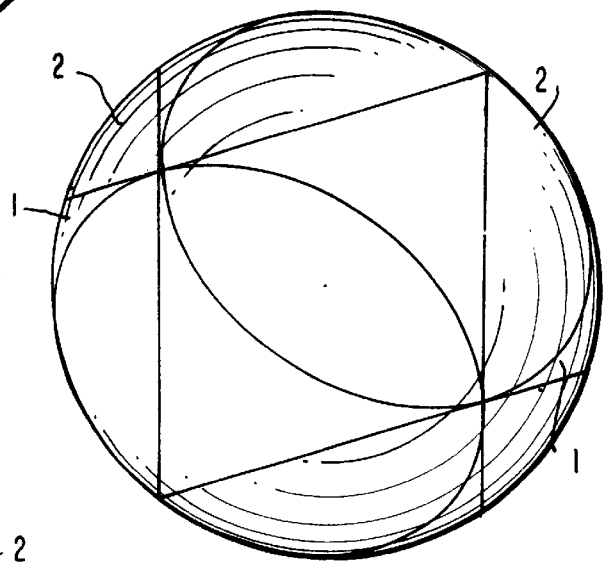
FIG. 2B is a perspective view of the ball of FIG. 2A rotated 90° to the right.
Figure 2C:
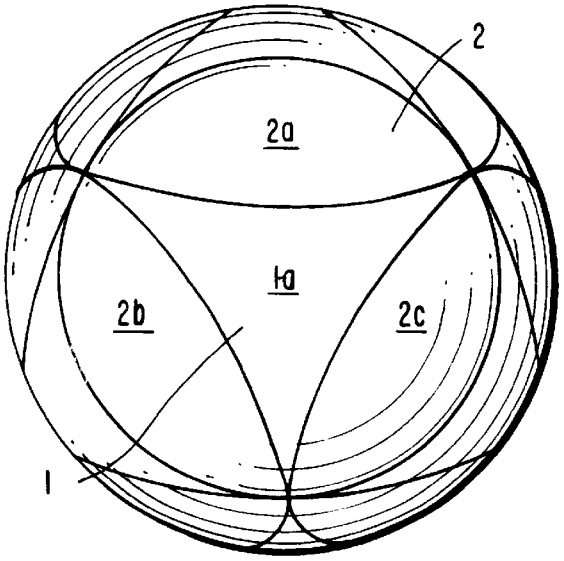
FIG. 2C is a perspective view of the ball of FIG. 2B rotated 90° to the right.
Figure 2D:
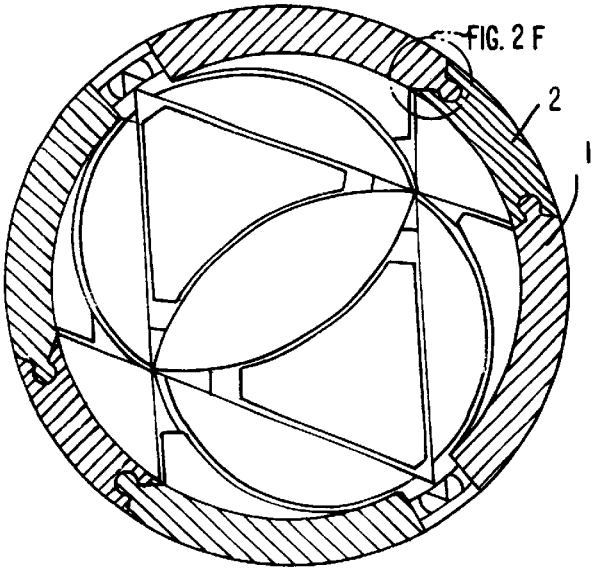
FIG. 2D is a cross-sectional view of the ball of FIG. 2C taken along section line 2D—2D and showing the interior of the ball.
Figure 2E:
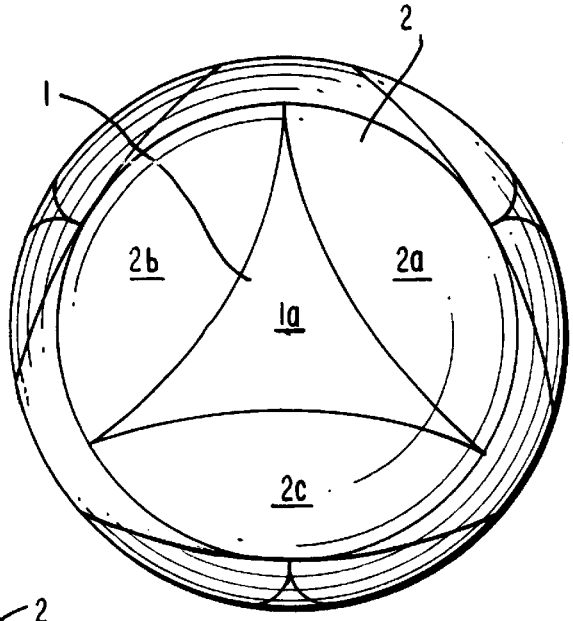
FIG. 2E is an exterior perspective view of the portion of the ball shown in FIG. 2D.
Figure 2F:
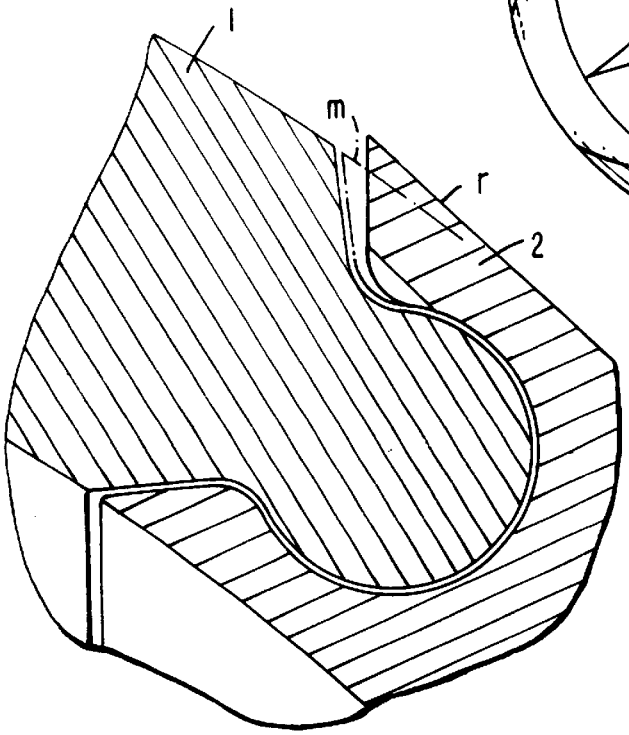
FIG. 2F is a further enlarged and detailed view of the circled cross-sectional segment of the mated elements of FIG. 2D.

The logical ball-shaped toy with broken surface including rotated and permutated elements, according to the attached drawings, is a toy which comprises of eight rotated elements 1 and twelve permutated elements 2. Each rotated element 1 makes contact with three permutated elements 2 and each permutated element 2 makes contact with two rotated elements 1. Rotated elements 1 and permutated elements 2 are shape connected as best shown in FIGS. 2D and 2F.

Figure 3A:
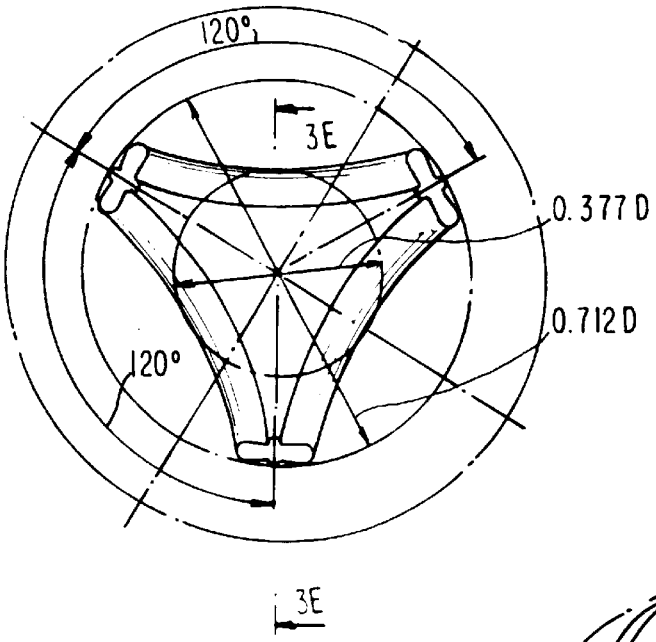
FIG. 3A is a perspective view of the inside of one of the rotated elements of the invention.
Figure 3B:
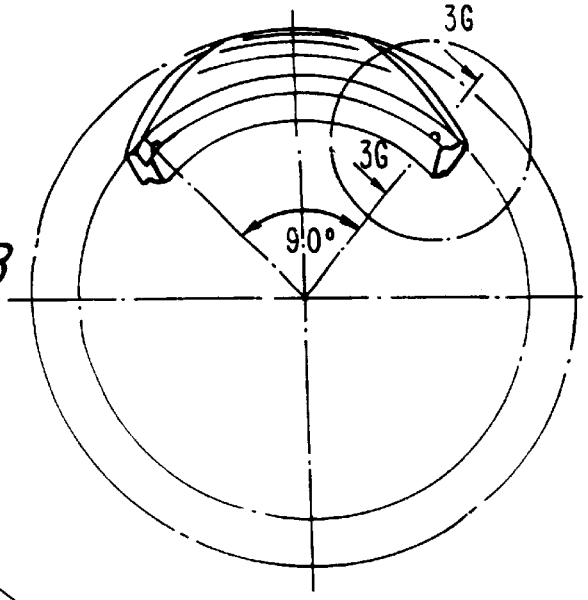
FIG. 3B is the rotated element of FIG. 3A rotated 90°.
Figure 3C:
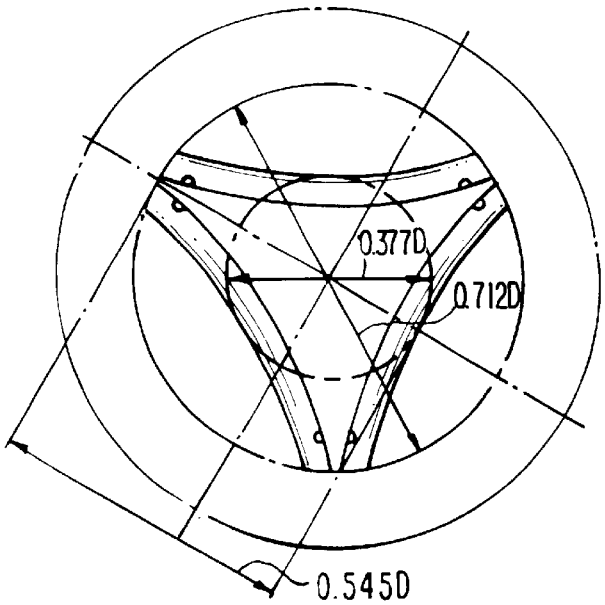
FIG. 3C is a perspective view of the exterior of the rotated element shown in FIG. 3A.
Figure 4A:
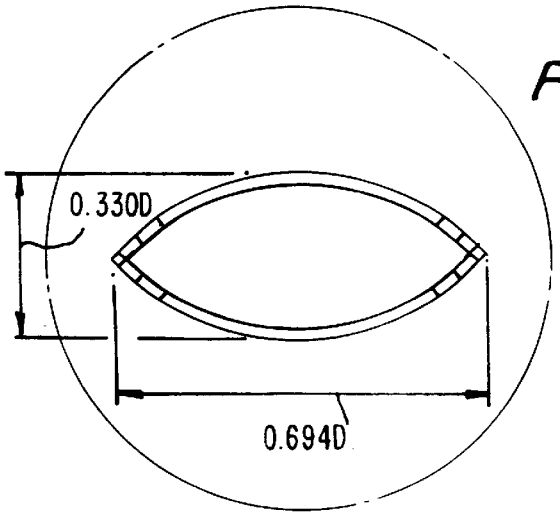
FIG. 4A is a perspective view of a permutator element.
Figure 4B:
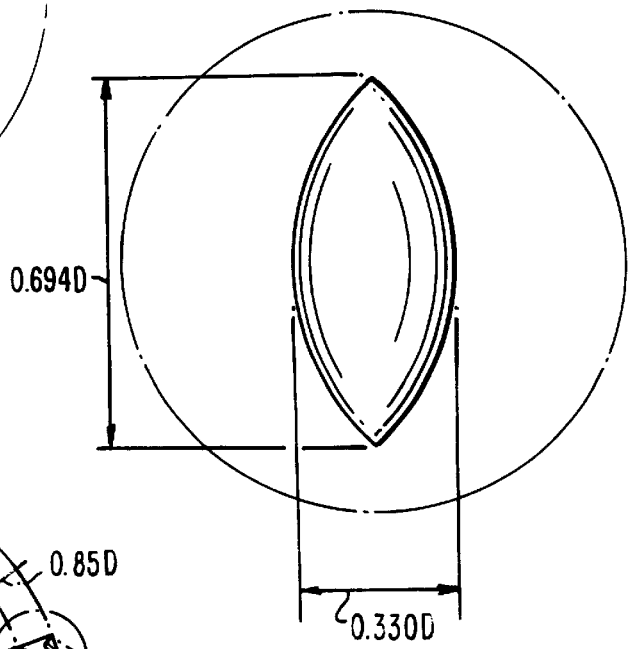
FIG. 4B is a perspective view of the element of FIG. 4A rotated 90°.
Figure 4C:
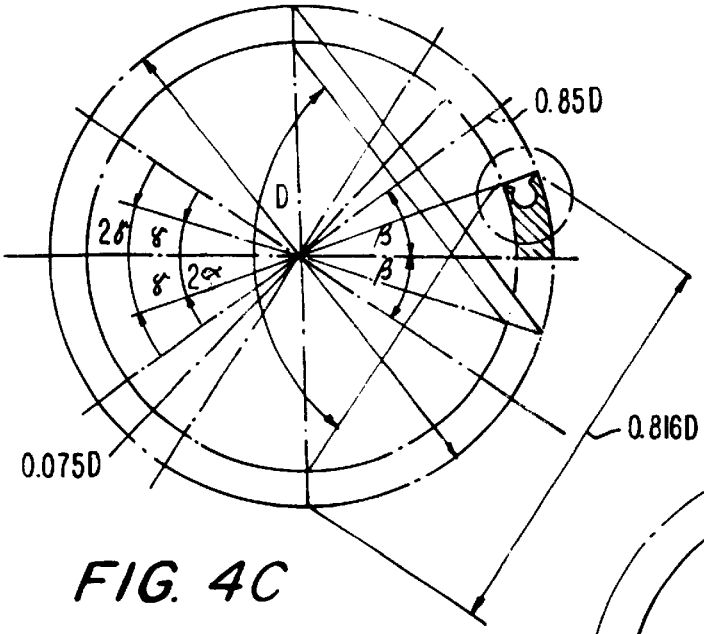
FIG. 4C is a view of the element of FIG. 4A, partly in section, taken along section line 4C—4C.
Figure 4D:
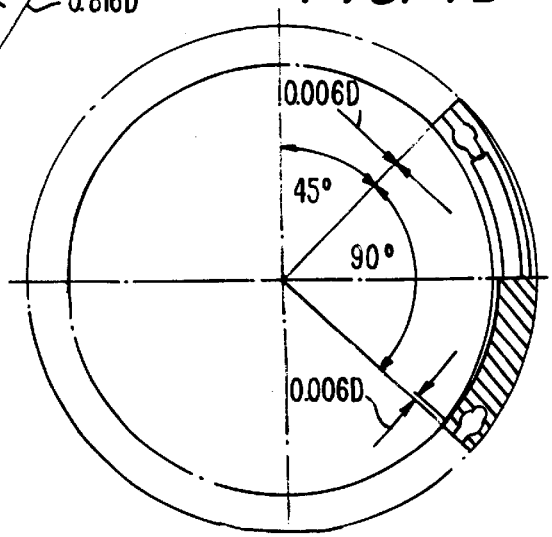
FIG. 4D is a side view of a permutator element, shown partly in section.

On lateral sides the rotated elements 1 are provided with projections (FIG. 3, Detail "L") and the permutated elements 2 are provided with grooves as shown in FIGS. 4C and 4I.

Figure 5A:
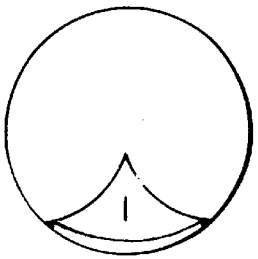
FIGS. 5A–5N illustrate the order of assembly of the rotator elements and the permutator elements to form one half of the ball of the invention constituting elements numbered 1–12.
Figure 5B:
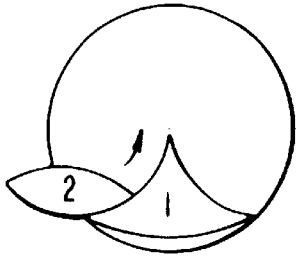
FIG. 5O shows the completed subassembly of elements numbered 1–12.
FIG. 5P shows the remaining elements assembled to form the remaining portion of the ball constituting elements numbered 13–20.
FIG. 5R is an expolded view of the ball showing the subassemblies of FIGS. 5O and 5P in position prior to mating to form the ball of the invention.
FIG. 5S is the view of the ball of FIG. 5R rotated 90° to the right.
FIG. 5T is a cross-sectional view of the ball when the subassemblies shown in FIG. 5S are moved toward mating relation.
FIG. 5U is a perspective view of the exterior of the ball when the subassemblies shown in FIG. 5S are moved in to mating relation.
Figure 5C:
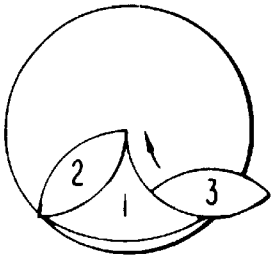
Figure 5D:
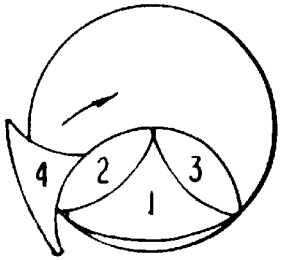
Figure 5E:
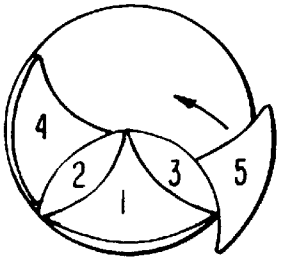
Figure 5F:
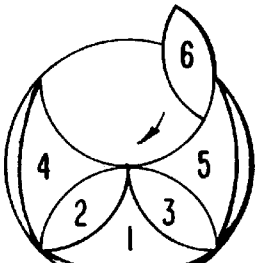
Figure 5G:
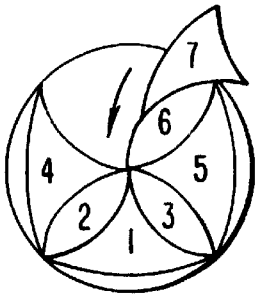
Figure 5H:
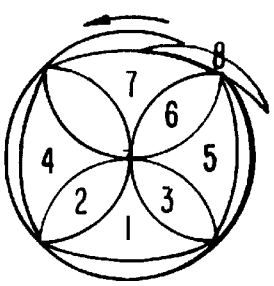
Figure 5I:
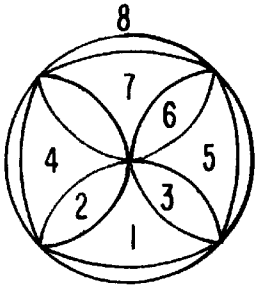
Figure 5J:
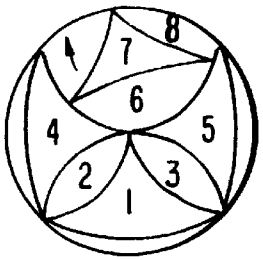
Figure 5K:
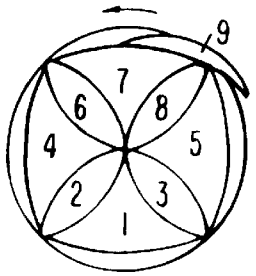
Figure 5L:
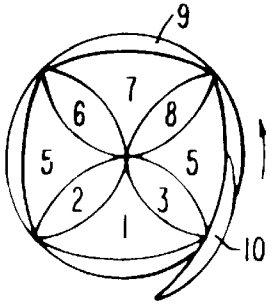
Figure 5M:
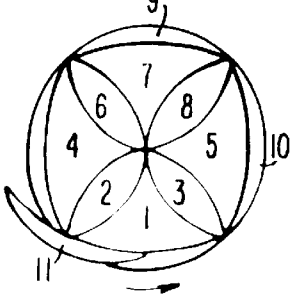
Figure 5N:
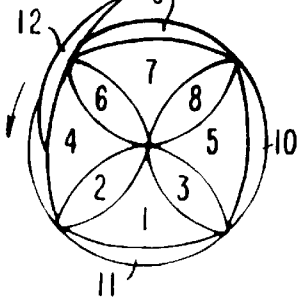
Figure 5O:
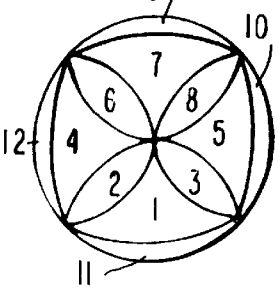
Figure 5P:
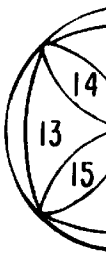
Figure 5R:
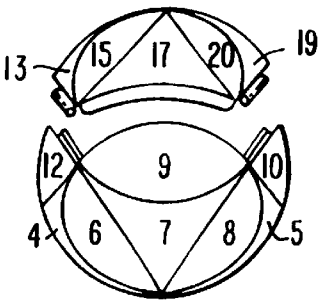
Figure 5S:
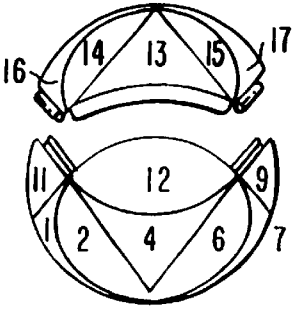
Figure 5T:
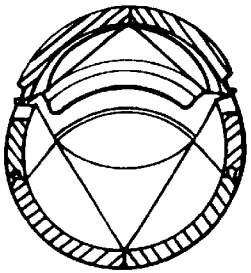
Figure 5U:
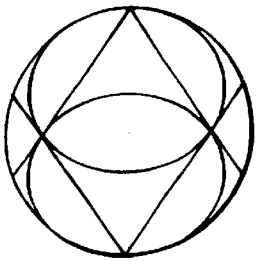
Figure 6A:
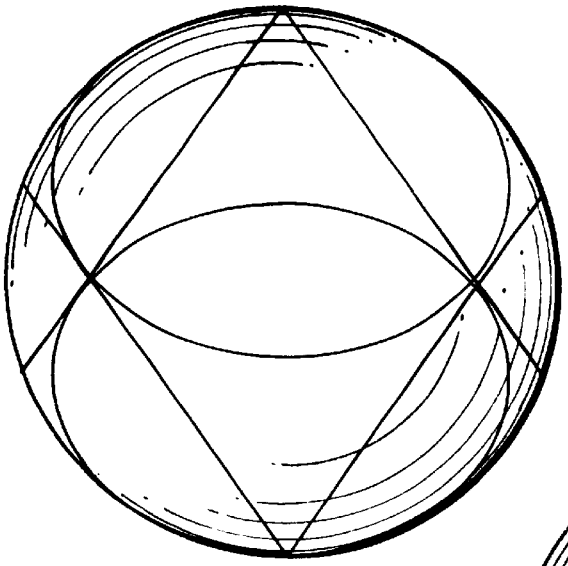
FIGS. 6A, 6B and 6C are perspective views of the exterior surface of the ball at three different rotational positions.
Figure 6B:
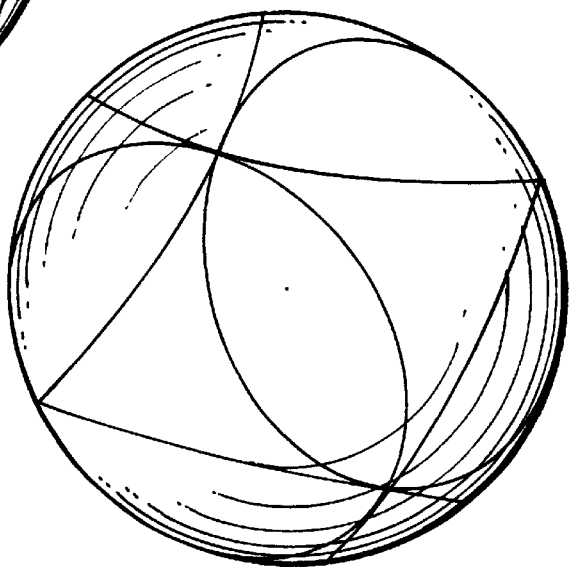
Figure 6C:
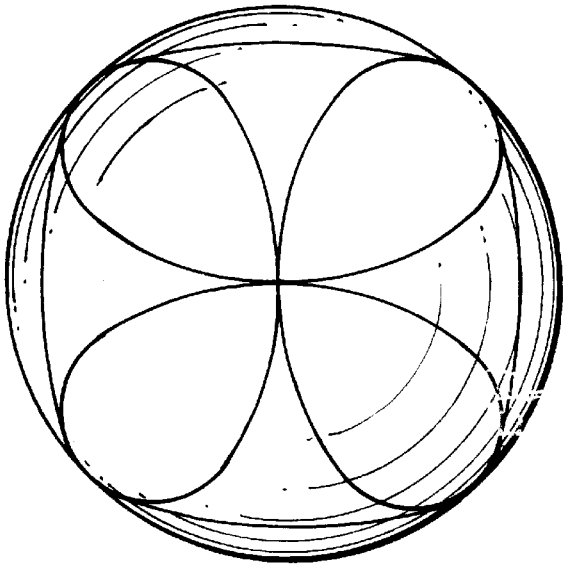

The toy is obtained by joining the rotated elements 1 and the permutated elements 2 according to the assembly drawing in accordance with the stepwise illustrations of FIGS. 5A–5U.

One rotated element 1 and three permutated elements 2 form a segment which, by hand applied force, can rotate three times for 120°. At segment rotation there comes to rotation of a single rotated element 1 and to permutation of three permutated elements 2. The toy altogether comprises of eight segments. The segments are brought into a definite position through audible and tactile effects established by bosses on the rotated elements 1 as shown in FIGS. 3B, 3G and 3H and by dimples in the grooves of the permutated elements 2 as shown in FIGS. 4G and 4H.

In the neutral position, all ball elements are blocked through fitting of the two bosses of the permutated elements 2 into two dimples of the rotated elements 1. The rotated element 1 has altogether six bosses and the permutated element 2 has four dimples. The bosses and the dimples are located on both ends of lateral projections of the rotated elements 1 as well as of grooves of the permutated elements 2. On the application of the manual force, indispensable for the operation of the toy, friction is created between the bosses and the dimples. The boss of the rotated element 1 lifts the segment for the fitting height and provides for segment rotation by 120° as far as the next dimples make a close fit. At the moment when the segment is "pushed" out of its "seat", the respective permutated elements 2 are supported by six bosses of the neighboring rotated elements 1. The same procedure takes place at rotation of the other seven segments. The toy has four rotation axes which are the diagonals of the cube in which the ball can be inscribed. The toy has no core (it is hollow). The dimensioning of the toy elements is associated with the ball diameter which theoretically can range from 0 till infinity.

The toy shall be assembled according to the assembly diagram FIGS. 5A through 5N. The assembly proceeds by assembling two semi-spheres whereof the upper one includes four rotated elements 1 and four permutated elements 2 is shown in FIG. 5O and the lower one includes four rotated elements 1 and eight permutated elements 2 is shown in FIG. 5P. On combining the upper Semi-sphere and the lower semi-sphere the four projections of the rotated elements 1 fit into the four grooves of the permutated elements 2 as shown in FIGS. 5R and 5S, whereby the groove extends and subsequently, after fitting and/or assemblage as illustrated in the cross-sectional view of FIG. 5T, reassumes the normal size and the appearance as shown in FIG. 5U.

One of the playing modes involves the combining of colours of the rotated and the permutated elements (provided that the rotated and the permutated elements are of different colours). The surface of the toyr is suitable for application of various symbols, pictures, numbers, letters, trade marks etc.

What is claimed is:

1. A logical ball-shaped toy with broken surface including eight rotated elements and twelve permutated elements with external diameter D and wall thickness d, characterized in that the rotated elements (1) are provided with projections, and permutated elements (2) are provided with Ω shaped grooves wherein one rotated element (1) and three permutated elements (2) form a segment which can rotate, and further characterized in that each rotated element (1) has six bosses and each permutated element (2) has four dimples-located on both ends of lateral projections of the rotated element (1) as well as of grooves of the permutated element (2).

* * * * *

UNITED STATES PATENT AND TRADEMARK OFFICE

CERTIFICATE OF CORRECTION

PATENT NO. : 6,244,597 B1
DATED : June 12, 2001
INVENTOR(S) : Josip Matijek

It is certified that error appears in the above-identified patent and that said Letters Patent is hereby corrected as shown below:

Title page,
Item [30], delete the country code "(BA)" and insert -- (HR) --.

Signed and Sealed this

Twenty-ninth Day of January, 2002

*Attest:*

*Attesting Officer*

JAMES E. ROGAN
*Director of the United States Patent and Trademark Office*